US007744734B2

(12) United States Patent
Li

(10) Patent No.: US 7,744,734 B2
(45) Date of Patent: Jun. 29, 2010

(54) HIGH CURRENT DENSITY CATHODE FOR ELECTROREFINING IN MOLTEN ELECTROLYTE

(75) Inventor: Shelly X. Li, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 566 days.

(21) Appl. No.: 11/844,829

(22) Filed: Aug. 24, 2007

(65) Prior Publication Data

US 2009/0050483 A1 Feb. 26, 2009

(51) Int. Cl.
*C25B 11/03* (2006.01)
*C25C 1/22* (2006.01)
*C25C 3/34* (2006.01)

(52) U.S. Cl. ..... 204/284; 204/280; 204/292; 204/293; 204/272; 205/46; 205/47; 205/48; 205/49

(58) Field of Classification Search ..... 204/293, 204/280, 284, 292, 272; 205/46, 47, 48, 205/49

See application file for complete search history.

(56) References Cited

U.S. PATENT DOCUMENTS

| | | | | |
|---|---|---|---|---|
| 3,940,318 | A * | 2/1976 | Arino et al. | 205/48 |
| 6,228,445 | B1 * | 5/2001 | Tverberg | 428/34.4 |
| 6,911,134 | B2 * | 6/2005 | Dees et al. | 205/43 |
| 2002/0005357 | A1 * | 1/2002 | Kondo et al. | 205/43 |
| 2004/0134785 | A1 * | 7/2004 | Gay et al. | 205/46 |
| 2010/0084265 | A1 * | 4/2010 | Lee et al. | 204/273 |

* cited by examiner

*Primary Examiner*—Bruce F Bell
(74) *Attorney, Agent, or Firm*—Alan D. Kirsh

(57) ABSTRACT

A high current density cathode for electrorefining in a molten electrolyte for the continuous production and collection of loose dendritic or powdery deposits. The high current density cathode eliminates the requirement for mechanical scraping and electrochemical stripping of the deposits from the cathode in an anode/cathode module. The high current density cathode comprises a perforated electrical insulated material coating such that the current density is up to 3 A/cm$^2$.

12 Claims, 4 Drawing Sheets

HIGH CURRENT DENSITY CATHODE FOR ELECTROREFINING IN MOLTEN ELECTROLYTE

GOVERNMENT RIGHTS

The United States Government has certain rights in this invention pursuant to Contract No. DE-AC07-05-ID14517, between the United States Department of Energy and Battelle Energy Alliance, LLC

FIELD OF THE INVENTION

This invention relates to electrorefining in molten salt electrolytes and more specifically to electrorefining utilizing a cathode having a high current density to produce loose dendritic or powdery deposits.

BACKGROUND

Electrorefining processes have been used to recover high purity metal or metals from impure feed material and more particularly to recover uranium and plutonium from spent nuclear fuel in a molten salt electrolyte. In the electrorefining process spent nuclear fuel forms the anode. The uranium in the spent fuel is separated from fission products and collected at the cathode through the electrorefining process. Controlling the morphology of uranium metal, which is the major constituent of spent nuclear fuel, deposited at the cathode has been a challenge for the electrorefining process.

FIG. 1 shows a sectional view of an engineering scale Mark-V (Mk-V) electrorefiner 10 operated at the Materials and Fuels Complex (MFC) site of the Idaho National Laboratory (INL) to process spent blanket fuel from the Experimental Breeder Reactor II reactor. The design and operation of the Mk-V electrorefiner is described in "*Uranium Transport in a High-Throughput Electrorefiner for EBR-II Blanket Fuel*", Rajesh K. Ahluwalia, Thahn Q. Hua, and DeeEarl Vaden, Nuclear Technology, Vol. 145, pp 67-81, January 2004. The Mk-V electrorefiner comprises a metallic vessel 12 preferably constructed of an iron alloy. Within the vessel 12 is an electrolytic salt 14 such as LiCL-KCl eutectic with up to 6 wt % of $UCl_3$. Vessel heaters 15 are used to maintain the electrolytic salt 14 at an operating temperature of approximately 500° C. Multiple anode/cathode modules (ACM) 16 are submerged in the electrolytic salt 14. A stirrer assembly 20 is disposed within the vessel 12 to maintain a flow of the electrolytic salt 14. Rotating contractors 22 provide for the rotation of the anode 35 within the anode/cathode modules 16.

Multiple concentric cathode tubes 26 within an ACM 16 are shown in FIG. 2 and FIG. 3. Also shown in FIG. 2 and FIG. 3 are multiple scrapers 32 positioned on the multiple anode baskets. The scrapers 32 are used to remove the built up uranium deposit on the cathode tubes 26 when the anodes 35 are rotating in the direction of the arrow shown in FIG. 3. As shown in FIG. 2, product collection bucket 34 is disposed at the bottom of the ACM 16 to collect the uranium deposit that is scraped off of the cathode tubes 26.

During the operation of the Mk-V electrorefiner, uranium in spent fuel is electrochemically dissolved and collected over many cycles, depending on the amount of fuel loaded in the anode baskets. Each cycle consists of three steps: (1) a direct-transport (DT) step in which uranium dissolves from the rotating anode basket and deposits on the cathode tube; (2) a cathode stripping step in which the polarity is reversed to electrotransport material on the cathode tube back to the anode basket; and (3) a wash step to physically dislodge material that may be been held up between the anode basket and cathode tube. Simulated cyclic variation of current and voltage during operation of the Mk-V electrorefiner is shown in FIG. 12 of the referenced Ahluwalia et al. publication.

A disadvantage of the Mk-V electrorefiner concentric anode-cathode design is that the uranium deposit does not continuously fall off the cathode as desired. Electrical shorting caused by the jamming of uranium deposition between the anode and cathode tubes has been frequently observed. The stripping and wash steps described above, and the use of scrapers to remove the deposited uranium from the cathode for collection in the product collection bucket, limit the efficiency and throughput of the electrorefining process.

BRIEF SUMMARY OF THE INVENTION

Aspects of the invention relate to a high current density cathode for electrorefining in a molten electrolyte. The high current density cathode comprises a stainless steel tube having an interior surface, a portion of the stainless steel interior surface being coated with an electrical insulating material, the electrical insulating material having multiple perforations therein to expose portions of the stainless steel tube interior surface, thereby providing a high current density cathode. The cathode of the present invention is capable of achieving a current density of up to 3 $A/cm^2$ when it is employed in the Mk-V electrorefiner. In one embodiment of the invention, the electrical insulating coating material comprises $Y_2O_3$ (7%) stabilized $ZrO_2$.

Another aspect of the invention is an electrorefiner apparatus that utilizes a high current density cathode for electrorefining spent nuclear fuel. Such an electrorefiner is capable of achieving greater efficiencies and thoughtputs in processing spent fuel than conventional electrorefiners because deposited dendrites are continuously removed from the cathode, thereby eliminating the inefficient scraping and electrochemical stripping steps of conventional electrorefining systems that are used for processing spent fuel.

Still another aspect of the invention is an electrorefining process for continuously recovering uranium from spent fuel using a high current density cathode to produce loose dendritic or powdery deposits.

DETAILED DESCRIPTION OF THE INVENTION

Figure 1:
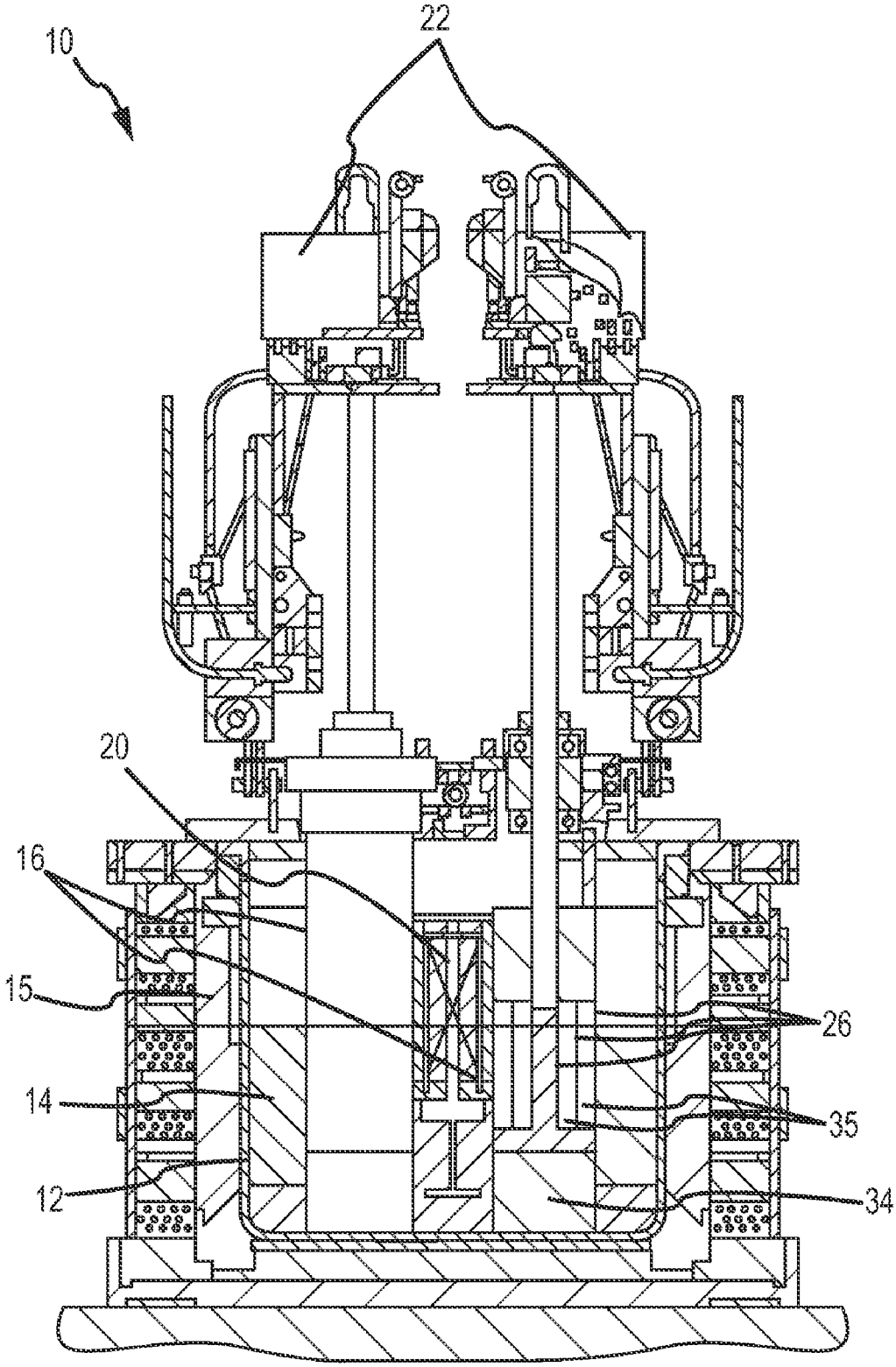
PRIOR ART FIG. 1
FIG. 1 is a sectional view of a conventional Mk-V electrorefiner.
Figure 2:
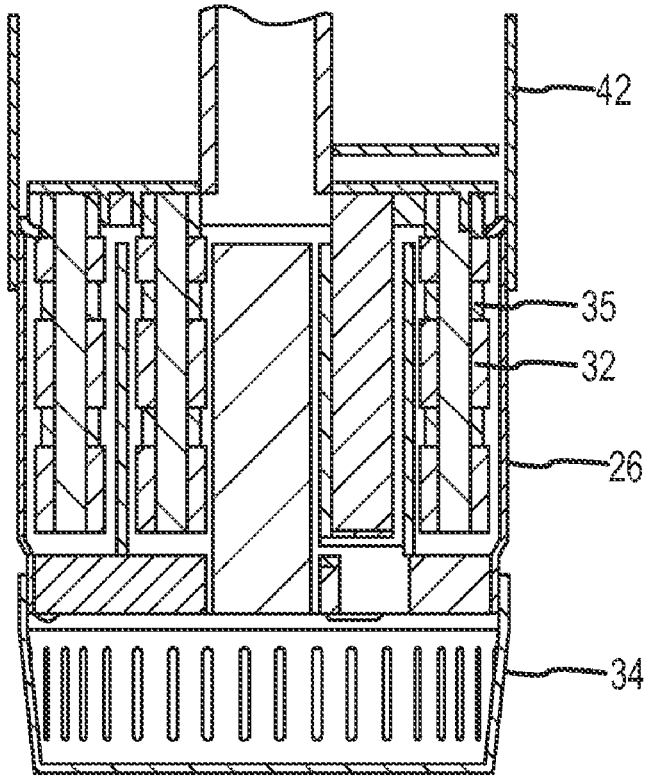
PRIOR ART FIG.2
FIG. 2 is a sectional view of a concentric anode/cathode module used in conventional Mk-V electrorefiner.
Figure 3:
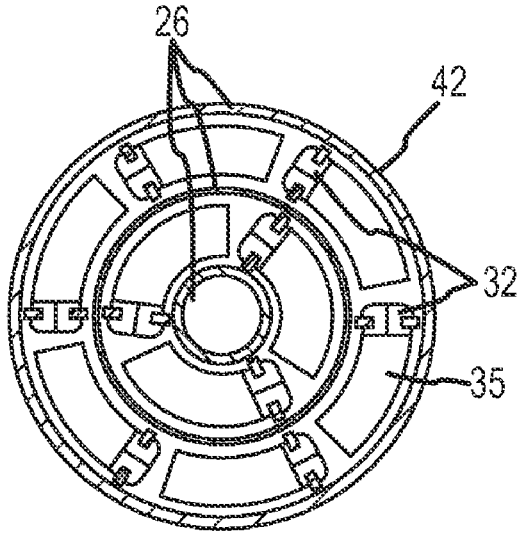
PRIOR ART FIG.3
FIG. 3 is a plan view of a concentric anode/cathode module used in conventional Mk-V electrorefiner.
Figure 4:
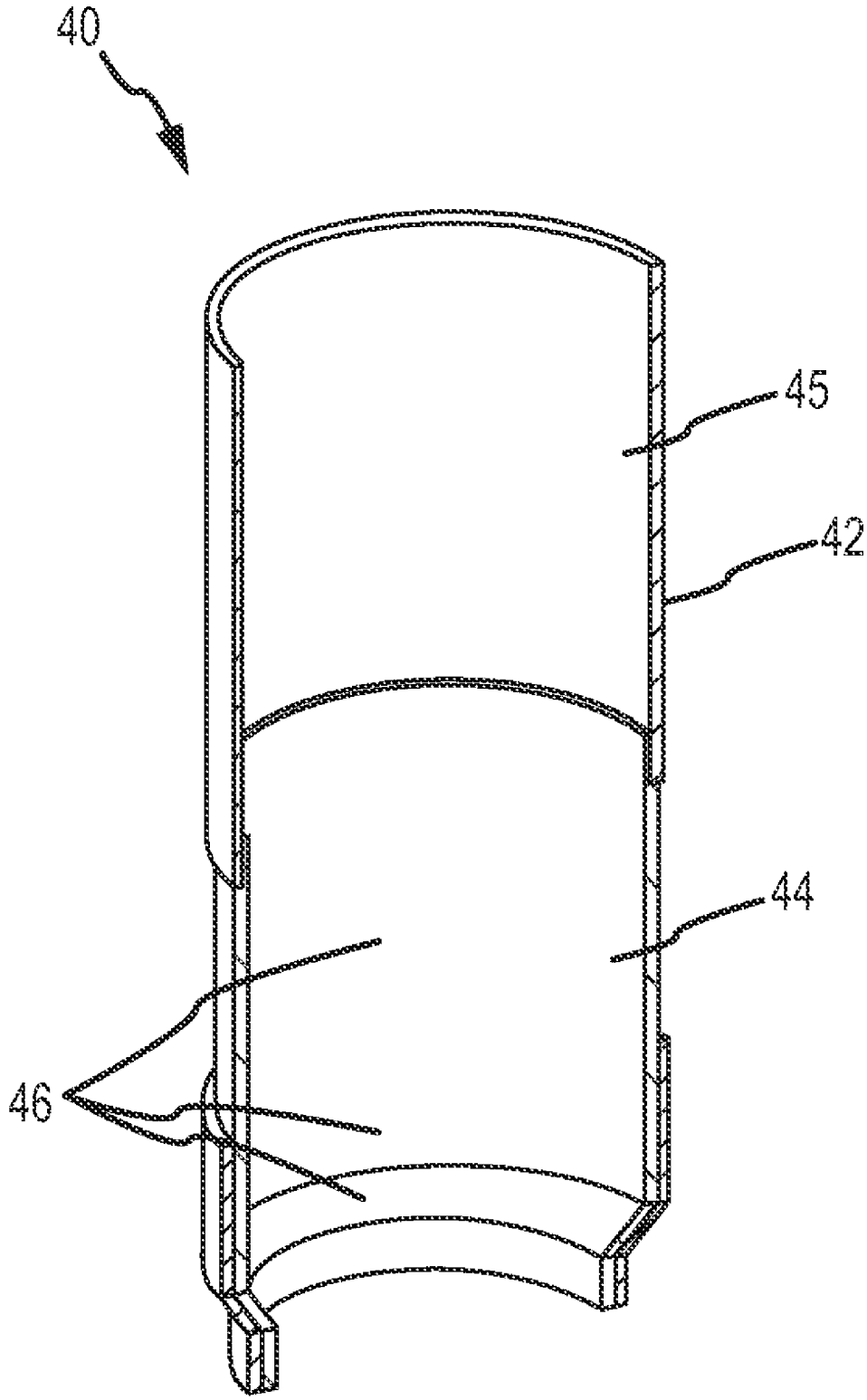
FIG. 4 is a sectional view of a high current density cathode of the present invention.

Referring now to FIG. 4, the cathode tube 40 of the present invention is shown. The present invention eliminates all interior concentric cathode tubes 26 that are shown in FIG. 2 and FIG. 3. Cathode tube 40 comprises an exterior stainless steel tube 42. The interior of cathode tube 40 has an electrical insulating coating 44 attached to a lower portion of the cathode tube 40. In one embodiment of the invention, electrical insulation 44 is comprised of $Y_2O_3$ (7%) stabilized $ZrO_2$. The insulating material coating 44 can be plasma sprayed onto the cathode tube 40 interior surface 45 or applied by other known methods. Preferably the insulating coating 44 is at least 0.1 mm in thickness to provide sufficient electrical insulation of the cathode tube 40.

The electrical insulation coating 44 is perforated to expose portions of the stainless steel cathode tube 42 thereby providing electrical communication between the cathode tube 42 and anode 35. Perforation of the electrical insulation coating 44 can be accomplished by manually drilling or conventional electrical discharge machining methods. FIG. 4 shows multiple perforations 46 wherein the stainless steel interior surface 45 of the cathode tube 40 is exposed to provide electrical communication between cathode tube 40 and anodes 35. For example, in tests conducted at the INL with the Mk-V electrorefiner, the electrical insulation coating was perforated in 400 locations to expose approximately 162 $cm^2$ of the stainless steel subsurface. The insulating material coating 42 substantially reduced the cathode surface area, from approximately 2026 $cm^2$ to 162 $cm^2$. Consequently, a current density of up to 3 $A/cm^2$ was achieved.

Figure 5:
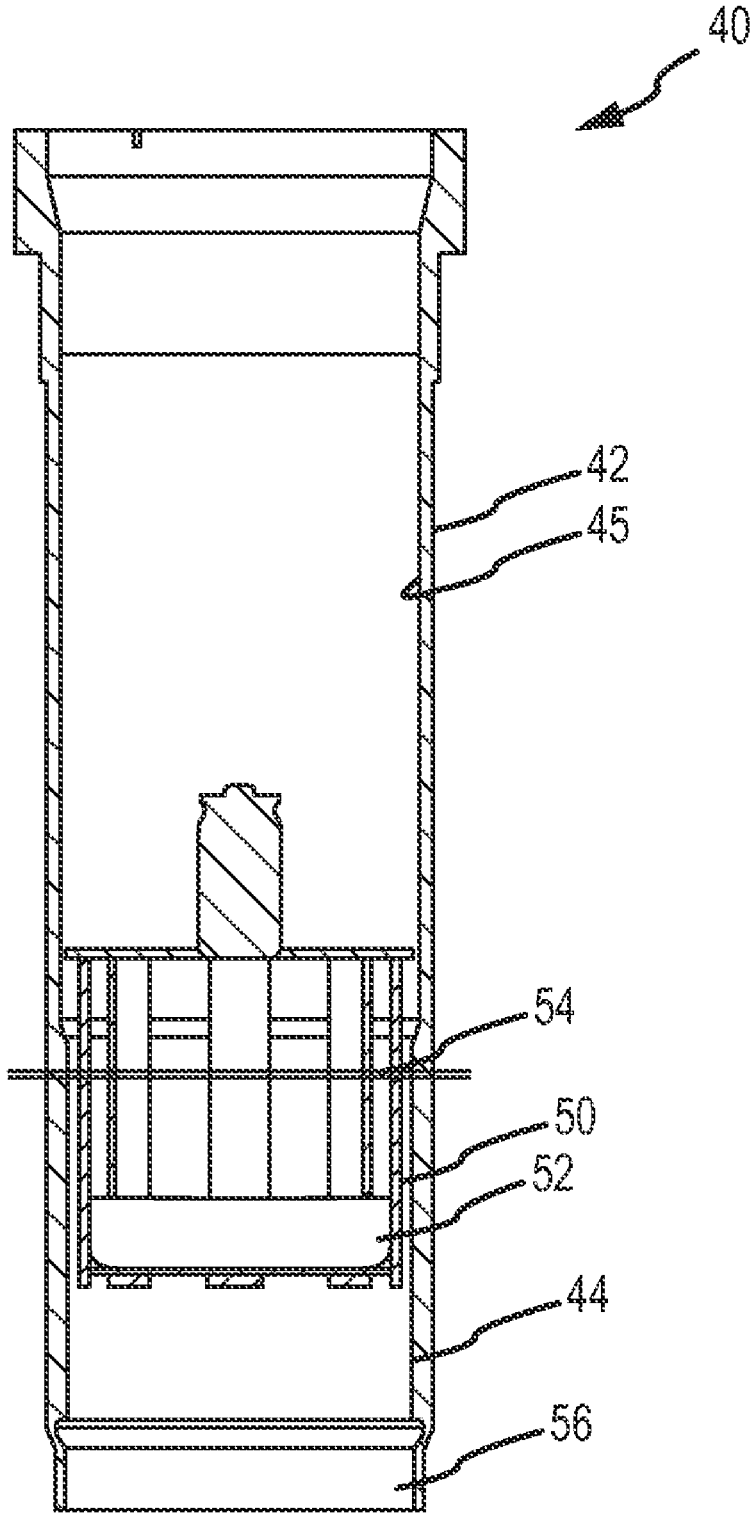
FIG. 5 is a sectional view of a high current density cathode and anode of the present invention.

Referring now to FIG. 5, the high current density cathode and anode of the present invention is shown. An anode basket 50 is positioned within the interior of stainless steel cathode tube 40. The electrical insulating material coating 44 is shown. An ingot 52 consisting mostly of uranium metal produced from spent fuel is located within the anode basket 50. The ingot 52 and a portion of the anode basket 50 are lowered below the electrolytic salt level 54. The electrolytic salt level is below the top of the electrical insulating material coating 44. A product bucket (not shown) is attached to the stainless steel cathode 40 bottom end 56.

The mechanism behind the high current density cathode design is to force the metal deposition process to approach the mass transfer limitation. For a single step mass transfer controlled electrodeposition process, the transfer rate can be expressed as a current density as shown in Equation (1);

$$i=nFD/\delta(C^o-C_{x=0}) \quad \text{Eq. (1)}$$

where i is the current density, D is the diffusion coefficient for the ion of interest in the electrolyte, F is the Faraday constant, n is the number of electrons transferred, δ is the effective thickness of the diffusion layer, $C^o$ is the bulk concentration of the depositing ions, and $C_{x=0}$ is the concentration of the depositing ions at the cathode/electrolyte interface. The current density reaches the highest value, or limiting current density, $i_l$, when $C_{x=o}$ approaches zero. That is:

$$i_l=nFD/\delta(C^o) \quad \text{Eq. (2)}$$

For a mass transfer controlled deposition process, deposits formed under limiting current density conditions usually show a loose dendritic or powdery morphology.

To produce a loose dendritic or powdery uranium deposit at the cathode, the following conditions must be met:

1. The deposition process must be mass transfer limited.
2. The electrorefining process must approach the limiting current density of the system.

For the electrorefining process in the Mk-V electrorefiner the desired reaction at the cathode is $U^{3+} \rightarrow U$. Metallic uranium is deposited on the cathode from $U^{3+}$ ions as a result of a reversible single reduction step involving the exchange of three electrons in molten LiCl—KCl, which indicates that uranium deposition is a mass transfer limited process. Thus the first condition for creating a loose dendrite deposit is satisfied.

To fulfill the second condition, the achievable cathode current density must approach the limiting current density of the system, which includes increasing the applied current and reducing the surface area of the cathode. Since the magnitude of the applied current for an electrorefiner is generally limited by the power supply, the most effective way to increase the achievable current density is to decrease the surface area of the cathode.

Electrorefining tests were conducted with the novel high current density cathode tube and a metal ingot anode in the Mk-V electrorefiner. The anode basker was rotated at 2 rpm during the tests to: (1) establish a steady state electrorefining process though mild convection conditions; (2) keep a stable diffusion-layer thickness at the salt/cathode interface; and (3) continuously remove the loose uranium dendrite formed at the cathode by the rotation. Using the high current density cathode of the present invention, it was observed that the current level applied to the electrorefiner generally remained steady over several days of continuous electrorefining, whereas using conventional anode/cathode modules under similar operating conditions resulted in significant voltage and current variations, polarity reversions, and potentially resulting in electrically shorting the anode and cathode. By maintaining the continuous transporting uranium to the cathode and eliminating the stripping and washing steps, the electrorefining process of the current invention is capable of greater operating efficiency and material throughput.

The high current densities at the cathode wall produced very loose dendritic deposits. The dendrites were continuously removed from the cathode wall by gravity or by rotating the anode during the electrorefining process, and no stripping operation was required.

The results, observation and operational experience gained from the tests are important to understand electrorefining theory and its applicability to deposition processes in molten salt electrolytes. The $Y_2O_3$ (7%) stabilized $ZrO_2$ insulating coating of the cathode tube was effective to achieve the desired high current density with the existing equipment, and to prove the concept of the high current density deposition in a molten salt environment.

The metal ingot 52 shown in FIG. 5 was for the purpose of testing the high current density cathode so that the testing parameters could focus on the cathode and the impact of anode loading on the cathode performance could be eliminated. To use the high current density cathode for treating spent fuel, the chopped fuel segments can be loaded into a perforated stainless steel anode basket and inserted into the high current density cathode tube. A continuous deposit removal from the cathode will be achieved. No stripping operation is required.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A high current density electrorefiner cathode, comprising, a stainless steel tube having an interior surface;

an electrical insulating coating on the stainless steel tube interior surface;

the electrical insulating coating having multiple perforations to expose the stainless steel tube interior surface and thereby provide a high current density.

2. The high current density electrorefiner cathode of claim 1 wherein the electrical insulating coating is $Y_2O_3$ (7%) stabilized $ZrO_2$.

3. The high current density electrorefiner cathode of claim 1 wherein each perforation exposes approximately 162 $cm^2$ of the stainless steel tube.

4. The high current density electrorefiner cathode of claim 1 wherein the electrical insulating coating perforations results in a cathode current density of up to 3 $A/cm^2$.

5. An electrorefiner for recovering uranium from spent nuclear fuel, comprising:

a vessel containing a molten electrolytic salt;

a stainless steel cathode tube having an interior surface, a portion of the cathode tube interior surface having an electrical insulating coating and being disposed within the electrolytic salt, said electrical insulating coating having multiple perforations which expose said stainless steel cathode tube to said electrolytic salt and thereby creating a high current density in said cathode, a perforated anode basket containing spent nuclear fuel, said anode basket and fuel being disposed within said cathode tube and electrolytic salt;

an electrical power supply in electrical communication with said cathode and said perforated anode basket to provide electrical power to said cathode and anode basket;

a product collection bucket below said cathode and anode for collecting uranium deposited on said cathode.

6. The electrorefiner of claim 5 wherein the electrical insulating coating is $Y_2O_3$ (7%) stabilized $ZrO_2$.

7. The electrorefiner of claim 5 wherein the electrical insulating coating perforations results in a cathode current density of up to 3 $A/cm^2$.

8. The electrorefiner of claim 5 wherein the electrolytic salt is LiCL-KCl eutectic with up to 6 wt % of $UCl_3$.

9. A process for refining spent nuclear fuel in a molten electrolyte comprising the steps of:

providing an electrolytic vessel containing a molten electrolytic salt;

lowering a module comprising an anode basket and stainless steel cathode tube into the molten salt, the anode basket being loaded with spent nuclear fuel segments; the cathode tube having an interior surface coated with an electrical insulation material coating, said electrical insulating material coating have multiple perforations to expose the stainless steel cathode tube to the electrolytic salt;

providing electrical communication between the anode basket and stainless steel cathode tube though the multiple perforations in the insulating material coating;

transporting uranium from the spent fuel segments to the cathode tube;

collecting the uranium transported the cathode tube.

10. The process of claim 9 wherein the electrical insulating coating is $Y_2O_3$ (7%) stabilized $ZrO_2$.

11. The process of claim 9 wherein the electrical insulating coating perforations results in a cathode current density of up to 3 $A/cm^2$.

12. The process of claim 9 wherein the electrolytic salt is LiCL-KCl eutectic with up to 6 wt % of $UCl_3$.

* * * * *